US005826789A

United States Patent [19]

Decaux et al.

[11] Patent Number: 5,826,789

[45] Date of Patent: Oct. 27, 1998

[54] LITTER BIN

[75] Inventors: Jean-François Decaux, Londres, England; Jean-Charles Decaux, Madrid, Spain

[73] Assignee: Jean-Claude Decaux, Neuilly Sur Seine, France

[21] Appl. No.: 676,805

[22] Filed: Jul. 8, 1996

[30] Foreign Application Priority Data

Jun. 13, 1996 [FR] France ..... 96 07356

[51] Int. Cl.[6] ..... B65D 91/00

[52] U.S. Cl. ..... 232/43.2

[58] Field of Search ..... 232/43.1, 43.2, 232/43.5; 220/909; 209/702

[56] References Cited

U.S. PATENT DOCUMENTS

| | | | |
|---|---|---|---|
| 1,380,252 | 5/1921 | Richardson . | |
| 3,720,346 | 3/1973 | Cypher | 220/909 X |
| 4,775,066 | 10/1988 | Keppeler . | |
| 4,834,253 | 5/1989 | Crine | 220/909 X |
| 4,955,497 | 9/1990 | Winden et al. . | |
| 4,964,523 | 10/1990 | Bieltveldt et al. . | |
| 4,991,737 | 2/1991 | Edelman | 220/909 X |
| 5,046,635 | 9/1991 | Haas et al. . | |
| 5,062,540 | 11/1991 | Jenkins | 220/909 X |
| 5,101,997 | 4/1992 | Bagwell et al. . | |
| 5,244,218 | 9/1993 | Irwin | 220/909 X |
| 5,257,577 | 11/1993 | Clark | 220/909 X |
| 5,626,240 | 5/1997 | Friedrichs et al. | 220/909 X |

FOREIGN PATENT DOCUMENTS

| | | | |
|---|---|---|---|
| 0252437 | 1/1988 | European Pat. Off. . | |
| 0 432 306 A1 | 6/1991 | European Pat. Off. . | |
| 382 949 A | 2/1908 | France . | |
| 24 31 090 A | 1/1976 | Germany . | |
| 26 07 855 A | 9/1977 | Germany . | |
| 4007104 | 9/1991 | Germany | 220/909 |
| 92 00 872 | 5/1992 | Germany . | |
| 43 03 102 | 8/1994 | Germany . | |
| 94 11 308 | 9/1994 | Germany . | |
| 94 18 977 | 1/1995 | Germany . | |
| 117531 | 8/1969 | Norway | 232/43.2 |
| 120464 | 10/1970 | Norway | 232/43.2 |
| 539483 | 9/1941 | United Kingdom | 220/909 |
| 2 131 281 | 6/1984 | United Kingdom . | |
| 2260689 | 4/1993 | United Kingdom . | |

*Primary Examiner*—Jerry Redman
*Attorney, Agent, or Firm*—Oliff & Berridge, PLC

[57] ABSTRACT

The litter bin comprises a chest fixed to the ground and presents a side wall and a top that is pierced by a plurality of openings for receiving waste. The chest contains a plurality of upwardly open inserts each having an inside volume lying in the range 30 liters to 100 liters and each being disposed beneath a respective one of the various waste-receiving openings. The litter bin enables all of the inserts to be removed manually by a single operator, for the purpose of emptying the inserts.

19 Claims, 8 Drawing Sheets

FIG.9.
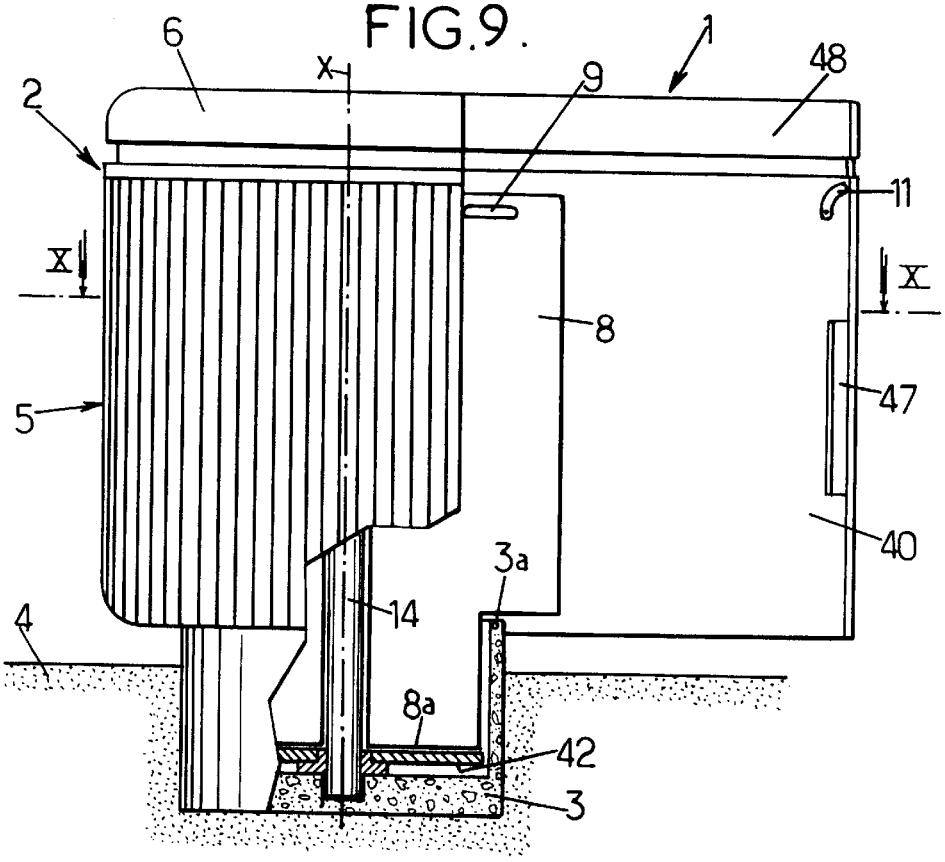
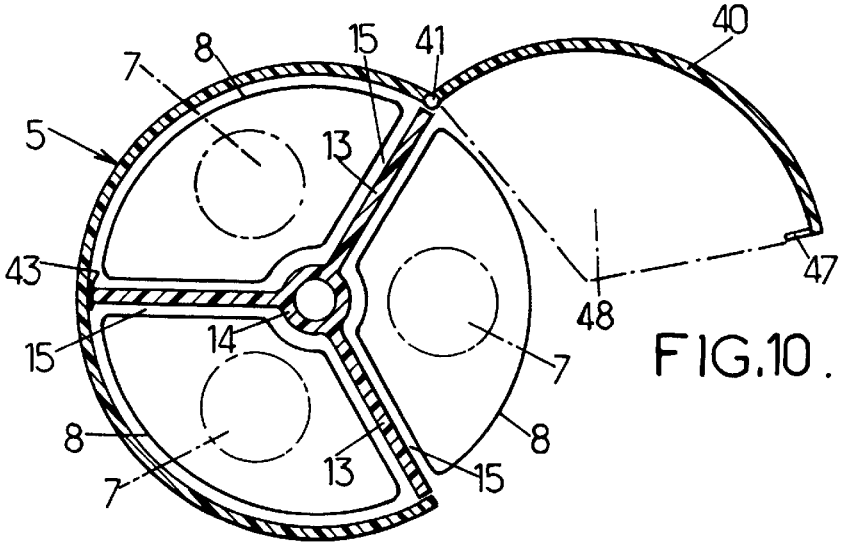
FIG.10.
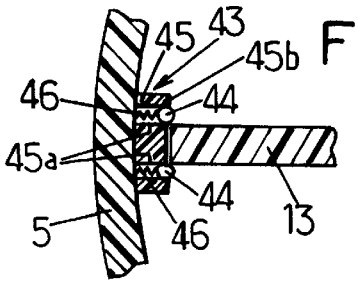
FIG.11.

LITTER BIN

The present invention relates to litter bins of the kind comprising a hollow chest fixed to the ground and having a side wall and a top with openings in parts thereof to receive waste, the chest including waste collection means and being capable of opening to enable the waste to be removed.

BACKGROUND OF THE INVENTION

In known litter bins of this type, the waste collection means are constituted by a single insert that generally has an inside volume lying in the range 30 liters to 120 liters and that is periodically emptied manually by an operator.

Such known litter bins nevertheless suffer from the drawback of having storage capacity for waste that is limited, such that in particularly busy locations, emptying operations need to be performed very frequently, sometimes several times a day.

To avoid that drawback, it is indeed possible to make use of large volume containers, but it is then necessary to make use of mechanized means for emptying such containers.

OBJECTS AND SUMMARY OF THE INVENTION

The present invention seeks in particular to mitigate those drawbacks.

To this end, the invention provides a litter bin of the kind in question, wherein the waste-collection means comprise a plurality of upwardly open inserts each having an inside volume lying in the range 30 liters to 100 liters, the top of the chest having a plurality of waste-receiving openings disposed over respective ones of the inserts, and the litter bin being shaped, when the chest is open, so as to enable all of the inserts to be extracted manually in succession by a single operator for the purpose of emptying said inserts.

By means of these dispositions, the litter bin has relatively large waste storage capacity while nevertheless remaining suitable for being emptied manually by an operator.

Further, the above dispositions can also be used, where appropriate, to collect waste selectively, with one or more of the inserts being reserved for certain specific kinds of waste (glass, aluminum, etc. . . . ).

In preferred embodiments, use may optionally be made of one and/or more of the following dispositions:

each insert has a bottom which is situated beneath the level of the ground, the side wall of the chest having a moving panel which defines at least one lateral access opening disposed and shaped so as to allow at least one insert to pass therethrough, with said lateral access opening having a bottom edge which is situated at a height of less than 80 cm above the bottom of the insert;

the top of the chest has, for each moving panel of the side wall, a portion which is secured to said moving panel and which defines a top opening enabling at least one insert to be raised prior to being extracted laterally from the chest through the lateral access opening corresponding to said moving panel;

the inserts are partially contained inside a buried base which is liquid-proof and which has a peripheral top edge disposed at a height of more than 5 cm above the ground;

the inserts are boot-shaped, each having a base extended by a hollow end that projects horizontally outwards beneath the level of the ground, the chest having a buried base which itself includes, beneath the level of the ground an enlarged portion receiving said projecting ends, the chest and the inserts being shaped so as to allow the upper portions of the inserts to be tilted outwards from the chest through the lateral access openings, thereby disengaging the projecting ends at the bases of the inserts, after which said inserts can be raised and extracted from the chest via the lateral access opening(s);

the chest is substantially circularly cylindrical in shape about a vertical axis of symmetry, each of the inserts having a horizontal section that is substantially in the form of an angular sector, and the chest further including positioning means for placing each insert beneath a waste-receiving opening;

the positioning means include housings situated inside the chest and secured to said chest so that each of them can receive a respective insert;

the side wall of the chest includes a moving panel which defines a single lateral access opening, means being provided to enable relative rotation between the side wall of the chest and the inserts about the vertical axis of symmetry to bring each of the inserts successively into coincidence with the lateral access opening so as to enable said insert to be extracted and emptied;

the inserts are carried by a support which is mounted to rotate about the vertical axis of symmetry, while the side wall of the chest is fixed relative to the ground;

at least the side wall of the chest is mounted to rotate about the vertical axis of symmetry, while the inserts are positioned by a support which is fixed relative to the ground;

the side wall is secured to the top of the chest and the positioning means comprise indexing means for defining a plurality of relative angular positions between the inserts and the side wall of the chest, each waste-receiving opening coinciding with one of the inserts in each of said angular positions;

the side wall is secured to the top of the chest and the positioning means comprise locking means for preventing any relative rotation between the inserts and the side wall of the chest when the lateral access opening of the chest is closed;

the side wall of the chest has a plurality of panels each extending between a bottom end and a top end, each insert being fastened to one of said panels and each panel being mounted to pivot through an angle of less than 45° about a horizontal axis in the vicinity of its bottom end, between a vertical position and a tilted position inclined towards the outside of the litter bin, thereby enabling the insert secured to said panel to be extracted;

at least the side wall assembly of the chest is displaceable vertically under drive from control means between an in-use position where said side wall surrounds the inserts and an emptying position where said side wall is situated above said inserts, enabling the inserts to be extracted laterally; and the top of the chest forms a cover which is pivotally mounted about a horizontal axis between a closed position and an open position enabling the inserts to be extracted upwards, the cover being urged towards its open position by a resilient device that is situated entirely in a vertical plane lying between two inserts.

BRIEF DESCRIPTION OF THE DRAWINGS

Other characteristics and advantages of the invention appear on reading the following detailed description of various embodiments, given as non-limiting examples, and described with reference to the accompanying drawings.

In the drawings:

FIG. 9 is a partially cutaway view of a fourth embodiment of a litter bin of the invention;

FIG. 10 is a section view on line X—X of FIG. 9;

FIG. 11 is a view showing a detail of FIG. 10;

Figure 1:
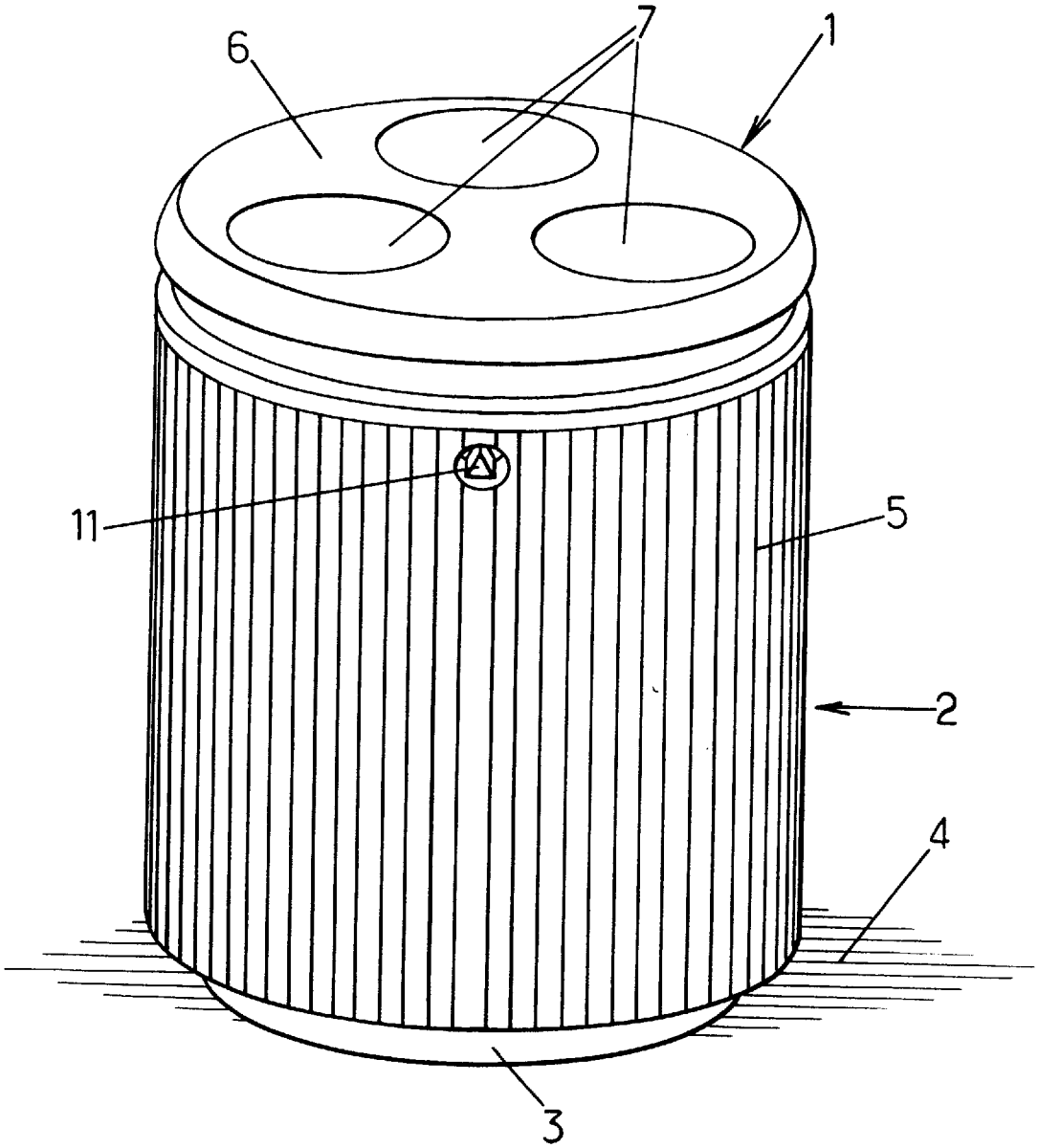
FIG. 1 is a perspective view of a first embodiment of a litter bin of the invention.

In the various figures, the same references are used to designate elements that are identical or similar.

MORE DETAILED DESCRIPTION

In the various embodiments described below, the litter bin 1 (a bin for collecting waste in public places) always comprises a chest 2 having a base 3 which may, for example, be made of prefabricated reinforced concrete and which is secured to the ground 4. The base is surmounted by a superstructure that is generally made of metal and comprises firstly a side wall 5 and secondly a top 6 which is pierced by a plurality of waste-receiving openings 7.

Purely by way of illustration, the chest 2 may, for example, have an outside diameter of about 80 cm or less, and a height above the ground of about 90 cm.

In the various embodiments shown in the drawings, the chest 2 is substantially in the form of a circular cylinder centered on a vertical axis of symmetry, however that shape is not limiting: the chest 2 could have a horizontal section that is elliptical, square, rectangular, etc.

In the embodiments of FIGS. 9 to 13, it is nevertheless preferable for the horizontal section of the chest to be circular.

In all circumstances, the chest 2 defines the hollow inside volume which receives a plurality of upwardly open inserts 8 each located beneath an opening 7 for receiving waste so as to collect the waste.

Each insert has an inside volume lying in the range 30 liters to 100 liters and preferably in the range about 60 liters to about 80 liters, so as to enable it to be handled manually by a single operator, even when full.

In the examples shown in the drawings, there are three or four such inserts, however there could be only two such inserts or there could be more than four.

Insert shape is unimportant providing the inserts 8 occupy substantially all of the inside volume of the chest 2. Nevertheless, when the chest 2 is circularly cylindrical, as in the examples shown in the drawings, it is particularly advantageous for the inserts 8 to be identical and for each of them to have a horizontal section that is substantially in the form of an angular sector.

Also, in all of the embodiments of the invention, the chest 2 has at least one moving panel which is normally closed but which can be opened to release an access opening to enable an operator to extract the inserts 8 manually from the chest, in particular by using handles 9 provided in said inserts. The operator can thus empty the various inserts 8 in succession, and then put them back into place in the chest 2.

Figure 2:
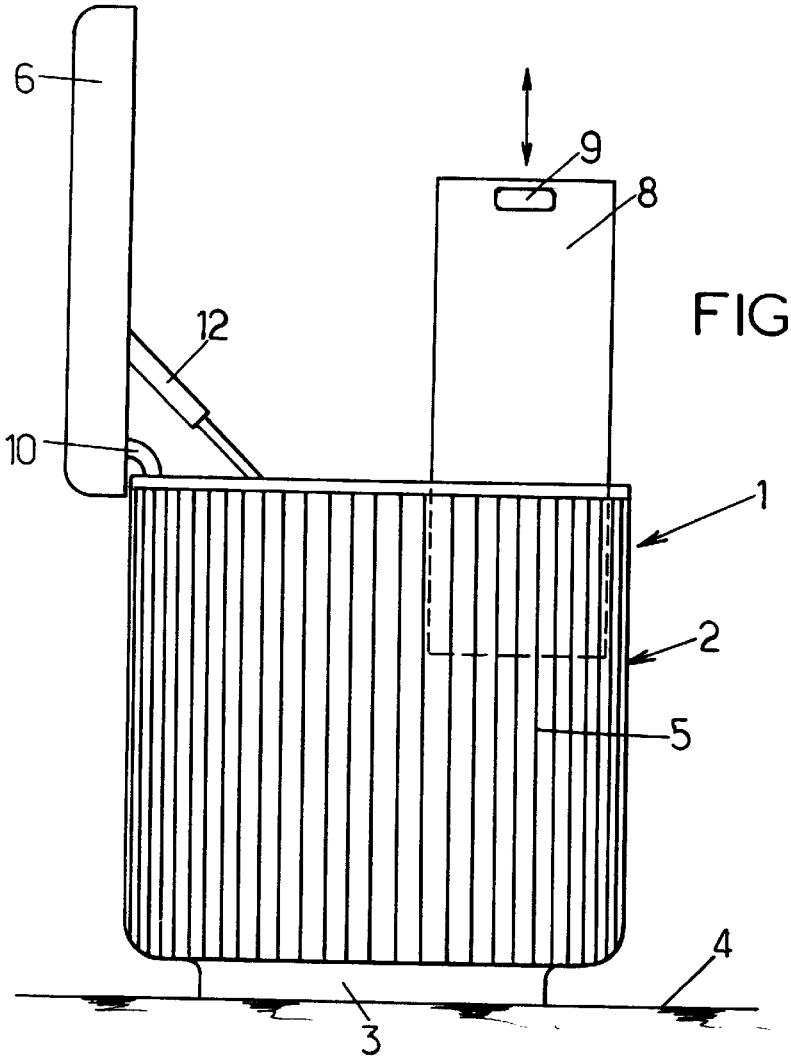
FIGS. 2 and 3 are respectively a side view and a plan view of the FIG. 1 litter bin in the open position.
Figure 3:
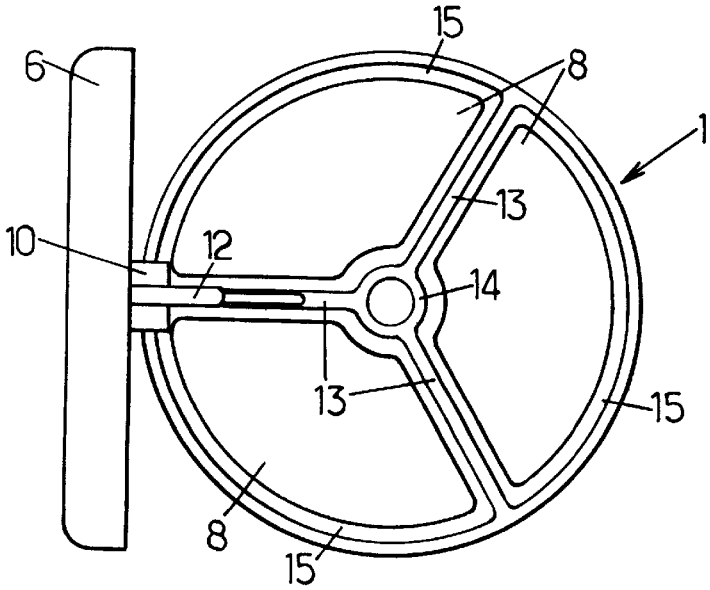

In the first embodiment of the invention as shown in FIGS. 1 to 3, the moving panel of the chest 2 is constituted by its top 6 which forms a pivoting cover.

The cover pivots about a horizontal axis embodied by a hinge 10 situated in the vicinity of the outside edge of said cover. The cover can thus be moved between a closed position (FIG. 1) in which it occupies a substantially horizontal plane overlying the inserts 8, and an open position (FIGS. 2 and 3) in which it extends in a substantially vertical plane disengaging all of the space situated above the inserts 8, thereby enabling said inserts to be extracted manually by being raised vertically.

The cover 6 is normally held in its closed position by a lock 11 which may be actuated by a special key, and the cover is preferably urged towards its open position by a resilient device such as a gas cylinder 12 which facilitates moving the cover 6 towards its open position and which holds said cover in said open position while the operator is handling the inserts 8.

The gas cylinder 12 is mounted between the bottom face of the cover 6 and a support disposed between two of the inserts 8, the gas cylinder 12 being contained entirely in a radial vertical plane situated between two inserts 8 so as to avoid impeding extraction of said inserts.

The support on which the gas cylinder 12 is mounted is preferably a radial partition 13 forming part of a set of three vertical radial partitions secured to the chest 2 and connected to one another via a vertical central post 14.

The partitions 13 thus define three housings 15 which receive the inserts 8, holding each insert beneath a respective waste-receiving opening 7.

Figure 4:
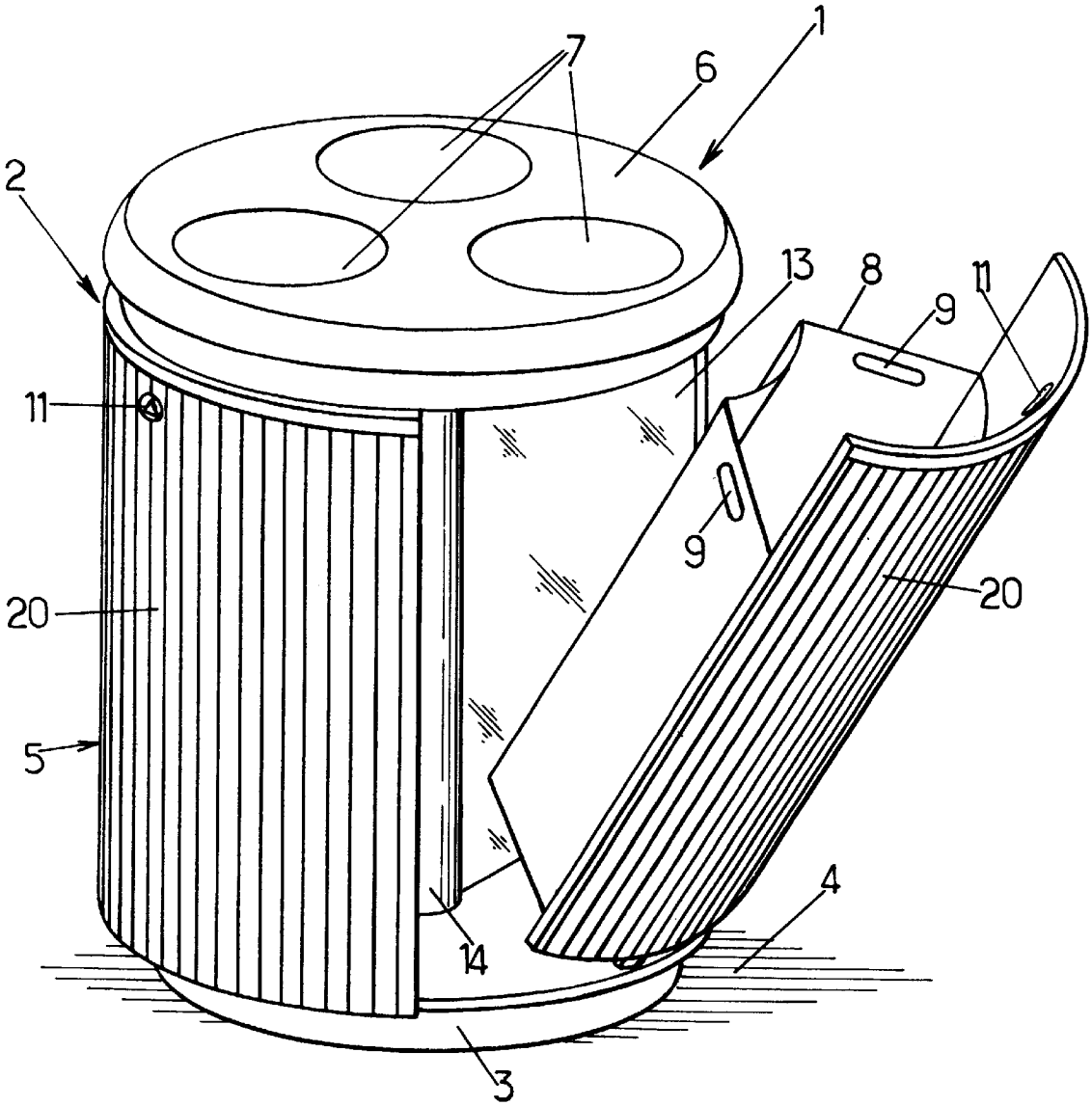
FIG. 4 is a perspective view of a second embodiment of a litter bin of the invention in a partially open position.
Figure 5:
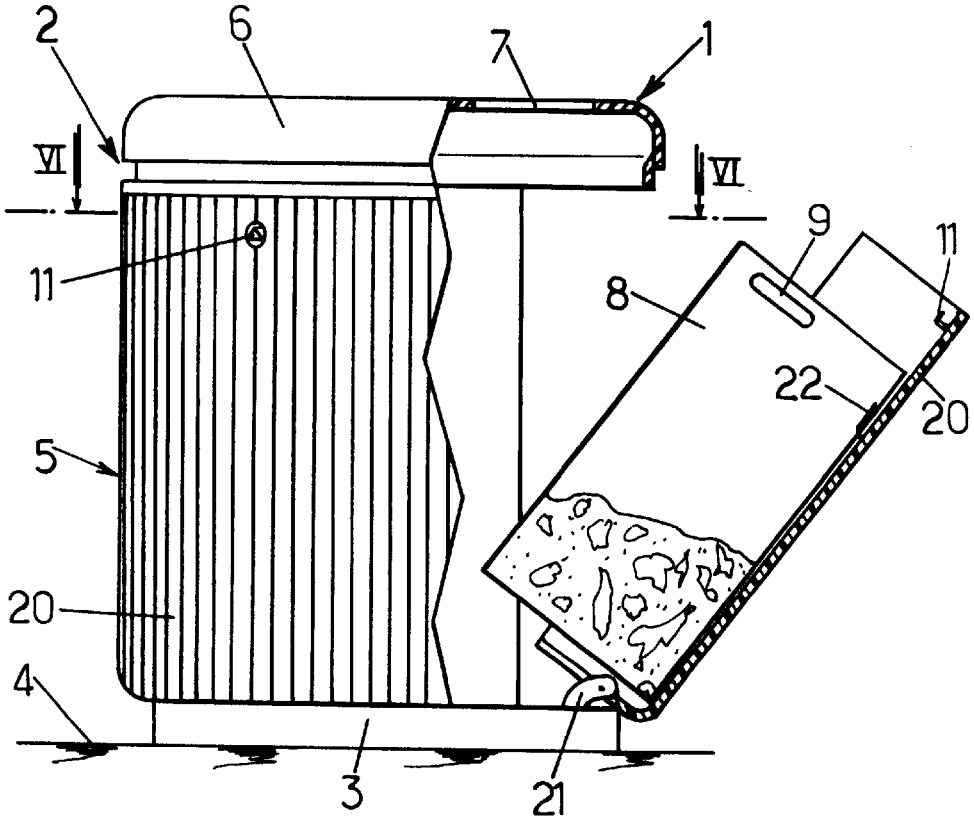
FIG. 5 is a cutaway view of the FIG. 4 litter bin.
Figure 6:
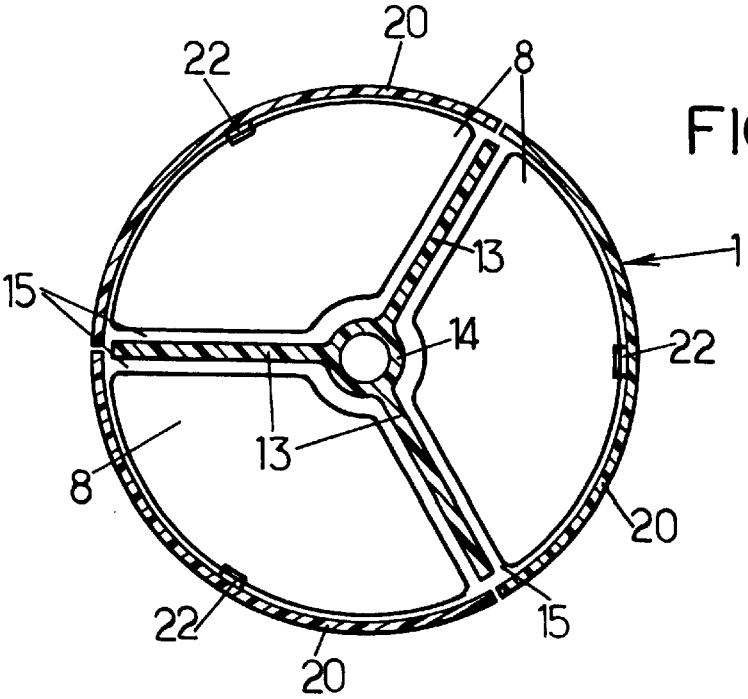
FIG. 6 is a section view on line VI—VI of FIG. 5, with the litter bin being in its closed position.

In the second embodiment of the invention shown in FIGS. 4 to 6, the chest 2 continues to have a fixed post 14, optionally together with three radial partitions 13, however the top 6 of the chest is now fixed and connected to the post 14, while the side wall 5 of the chest is constituted by three moving vertical panels 20. The panels 20 are mounted to pivot about horizontal axes of rotation embodied by respective hinges 21 situated in the vicinity of the bottom ends of said panels.

The inserts 8 are preferably fastened to the insides of the panels 20, e.g. by means of retaining tabs 22.

The panels 20 are normally kept in a vertical closed position by means of locks 11. When an operator seeks to empty the inserts 8 of the litter bin, the locks 11 of the various panels 20 need to be unlocked, after which the corresponding panel can be tilted outwards until it reaches an abutment position in which the panel is inclined relative to the vertical at an angle that is preferably smaller than 45°, e.g. an angle lying in the range 30° to 45°.

Once a panel 20 is in its open position, the operator can extract the insert 8 from the chest 2 by raising said sloping insert, which is a movement that is more ergonomic than a movement which is purely vertical.

In addition, the operator may optionally omit raising the insert 8 until it comes above the top end of the panel 20, doing no more than raise the insert a few tens of centimeters, after which it can be extracted from the chest 2 sideways, passing out through the gap left empty between the open panel 20 and one of the two adjacent panels 20.

Figure 7:
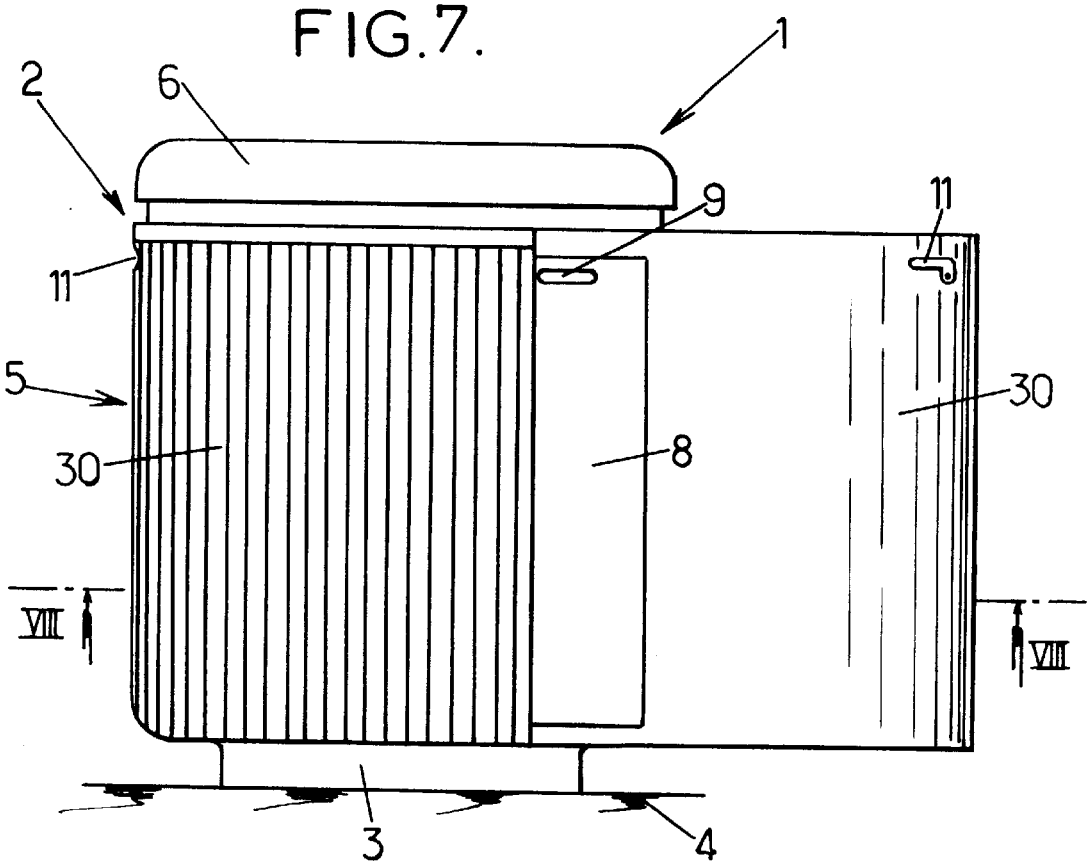
FIG. 7 is a side view of a third embodiment of a litter bin of the invention in a partially open position.
Figure 8:
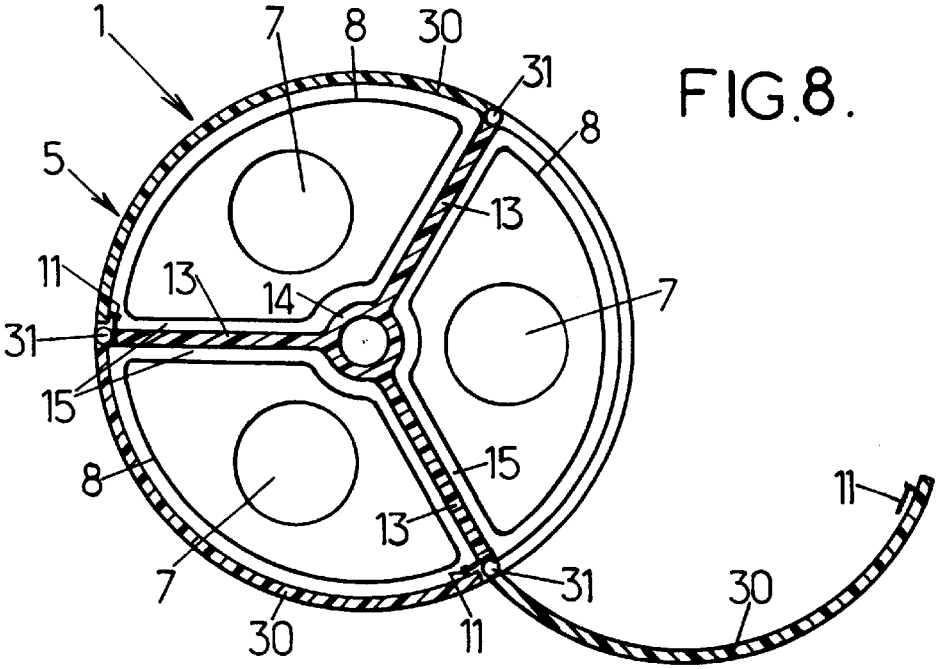
FIG. 8 is a section view on line VIII—VIII of FIG. 7.

In the third embodiment of the invention as shown in FIGS. 7 and 8, the inside of the chest 20 is again subdivided into three housings 15 by three radial partitions 13 which are fixed and which are connected together by a central post 14.

The side wall 5 of the chest is constituted by three doors 30 each of which occupies the angle extending between the radially outer ends of two partitions 13.

Each of the doors 30 is normally kept closed by means of a lock 11, and it can be opened by pivoting about a vertical hinge 31 connected to the radially outer end of one of the partitions 13.

In the embodiment shown in FIGS. 7 and 8, each insert 8 is merely placed on the base 3 inside its own housing 15, however, where appropriate, it would also be possible for the inserts 8 to be fastened to the top 6 of the chest, or for them to be fastened to the insides of the doors 30 by means of retaining tabs, as in the second embodiment of the invention.

In the fourth embodiment of the invention, as shown in FIGS. 9 to 11, the inside of the chest 2 is still subdivided into three housings 15 defined by three radial partitions 13 which are connected to one another by a central post 14 embodying a vertical axis X.

However, unlike the third embodiment, the side wall 5 of the chest is fixed over two-thirds of its periphery, while a single third of its periphery is constituted by a door 40 which is normally held closed by a lock 11, but which can be opened by pivoting about a vertical hinge 41 connected to the fixed portion of the side wall 5.

In order to enable an operator to extract all of the inserts 8 from the chest 2 through said single door 40, the inserts 8 and the partitions 13 are mounted to rotate about the vertical axis X, thereby enabling the various inserts 8 to be brought in succession into register with the opening released by the door 40.

To this end, in the embodiment shown in FIGS. 9 to 11, the central post 14 and the partitions 13 are secured to a turntable 42 on which the inserts 8 stand, and the entire assembly is mounted to rotate inside the chest 2.

In order to guarantee that the various inserts 8 are to be found under respective waste-receiving openings 7 when the door 40 is closed, the chest 2 also includes an indexing device 43 which holds the rotary assembly 13, 14, 42 in one of its three angular positions in which the inserts 8 come beneath the openings 7, said indexing device 43 releasing the rotary assembly only when it is actuated with sufficient force by an operator.

By way of non-limiting example, the indexing device 43 may be constituted by a set of two balls 44 which are mounted with clearance inside two bores 45*a* of a block 45 that is secured to the fixed portion of the side wall 5, and which are urged by two springs 46 to positions in which they come into abutment against a perforated closure plate 45*b* projecting beyond said plate 45*b* towards the inside of the chest 2.

When the moving assembly 13, 14, 42 is in one of its indexed positions, the two balls 44 lie on either side of one of the partitions 13 of the moving assembly and overlap the radial end of said partition: in order to rotate the rotary assembly 13, 14, 42, the operator therefore needs to exert sufficient torque on the assembly to cause one of the two balls 44 to be retracted into the block 45 against the thrust of the corresponding spring 46.

In addition, in order to guarantee that the rotary assembly 13, 14, 42 does not rotate while the litter bin is in use, whether rotation is accidental or due to tampering, it is advantageous to provide means for locking the rotary assembly when the door 40 is closed.

Advantageously, these locking means may be constituted by a rim 47 that projects substantially radially inwards from the free vertical edge of the door 40, said rim 47 being received between a partition 13 and an insert 8 when the door 40 is closed.

Optionally, the indexing device 43 could be omitted, with the rim 47 then constituting on its own the only indexing and locking means, given that the rim 47 prevents the door 40 from closing unless the rotary assembly 13, 14, 42 is placed in such a manner that each insert 8 is situated beneath a waste-receiving opening 7.

Also, and advantageously, the turntable 42 and the bottoms 8*a* of the inserts 8 are situated below the level of the ground 4 thus making it possible to use inserts 8 of sufficient volume while simultaneously restricting the outside diameter of the chest 2.

Under such circumstances, the bottom portions of the inserts 8 are located inside a recess formed in the base 3, which base has a side wall rising up to a top edge 3*a* which is situated, for example, more than 5 cm high and preferably at a height lying in the range 10 cm to 15 cm above the level of the ground 4: this ensures that running water does not penetrate into the base 3.

The inserts 8 are also preferably waterproof or lined internally with a leakproof bag to prevent any liquid that might penetrate into said inserts (raindrops, or liquid contained in beakers, bottles, cans, etc.) from penetrating into the inside of the base 3.

In order to make it easier to extract the inserts 8, the door 40 is secured to a portion 48 of the top 6 of the chest that occupies an angular sector of about 120°.

When the door 40 is open, it thus simultaneously disengages substantially all of the space situated above the insert 8 situated facing said door.

This makes it easy to extract the insert 8 by raising it vertically until its bottom 8*a* comes above the top edge 3*a* of the base, and then in displacing the insert horizontally towards the outside of the chest.

The height between the bottom 8*a* of the insert and the top edge 3*a* of the base, when the insert is resting on the turntable 42, is preferably less than 80 cm, and is advantageously less than 60 cm, so as to restrict the raising movement since that is the most difficult for the operator.

Optionally, the top 6 of the chest may be formed as a single piece, in which case the door 40 is not secured to a portion of said top 6: under such circumstances, the inserts 8 must be of a shape that is suitable for enabling them to be initially tilted towards the outside of the chest through the space released by the door 40, and then moved along a slope out from the chest 40 so as to be extracted therefrom.

Naturally, in the fourth embodiment of the invention, the turntable 42 and the bottoms 8*a* of the inserts 8 could be situated above the level of the ground, in which case the base 3 would have no need to be hollow and the top 6 of the chest could then be formed as a single piece, with the door 40 no longer being integral with a portion of said top.

Under such circumstances, the inserts 8 can be fastened to supports that are secured to the post 14 beneath the top 6 of the chest, in which case the turntable 42 could be omitted.

It will also be observed that the bottoms 8*a* of the inserts 8 could be disposed beneath the level of the ground 4 inside the base 3 in all three embodiments of the invention that are described above, and in particular in the third embodiment as described with reference to FIGS. 7 and 8 (in which case it would be advantageous for the doors 30 of the third embodiment of the invention to be integral with respective thirds of the top 6 of the chest so as to disengage the space situated above the inserts 8 when said doors 30 are opened).

Figure 12:
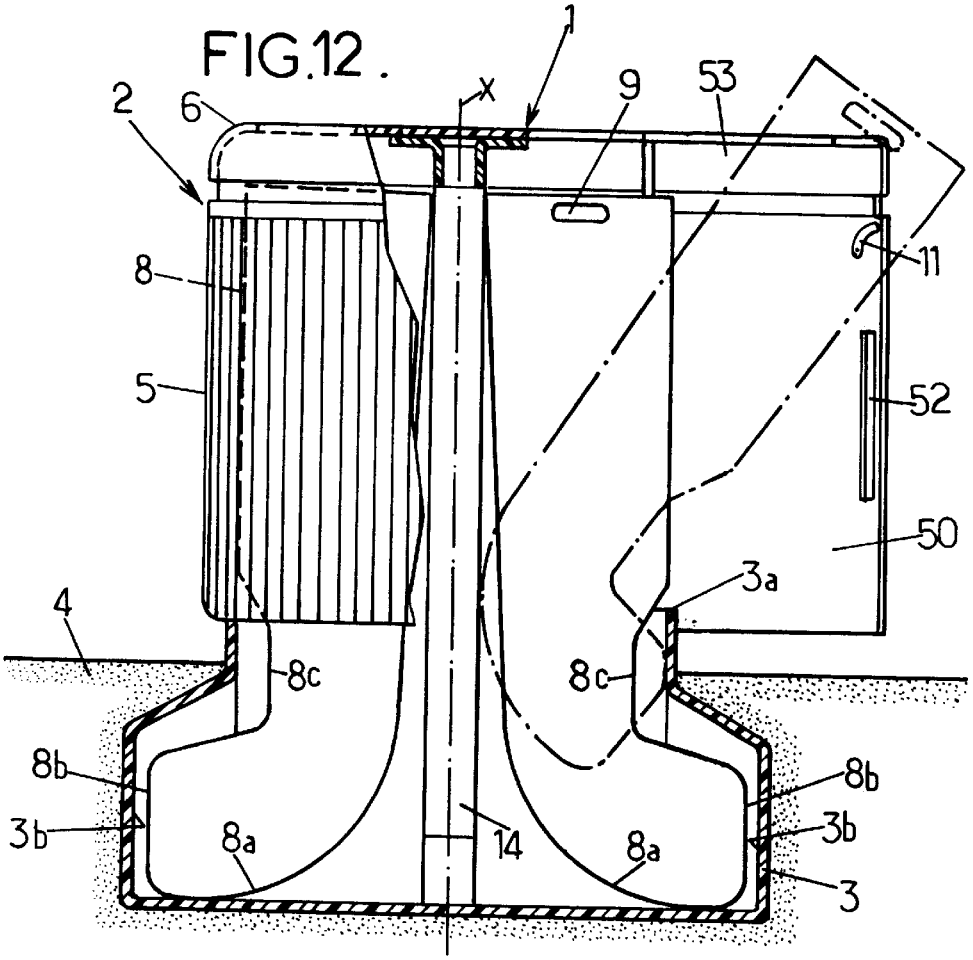
FIG. 12 is a view, partially in vertical section, showing a fifth embodiment of a litter bin of the invention, the section being on line XII—XII of FIG. 13.
Figure 13:
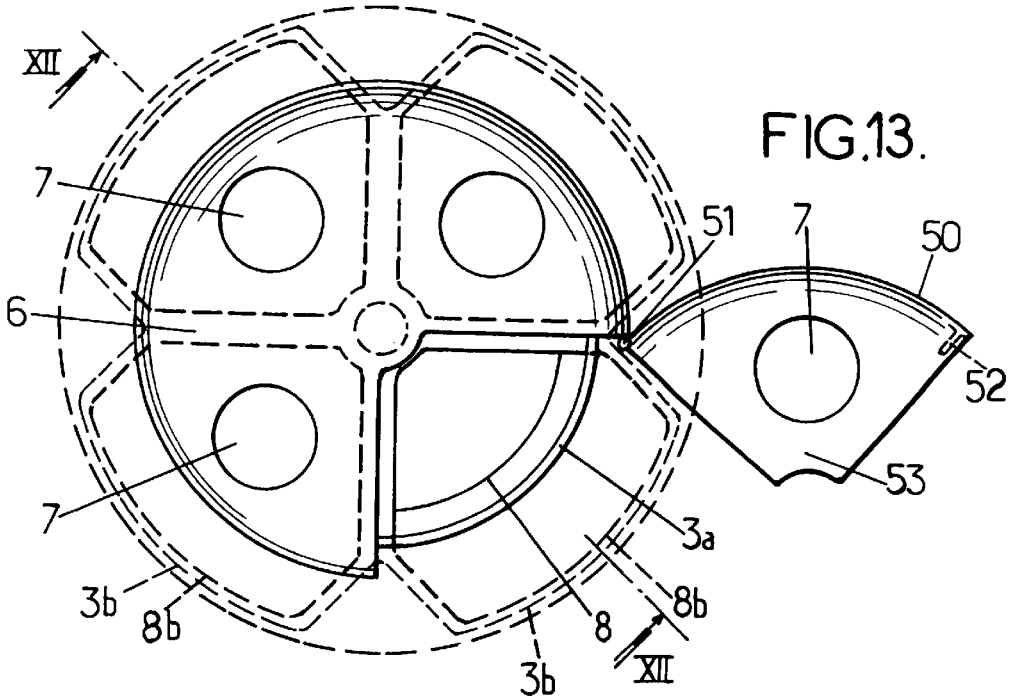
FIG. 13 is a plan view of the litter bin of FIG. 12.

In the fifth embodiment of the invention, as shown in FIGS. 12 and 13, the side wall 5 is again provided with a single door 50 which occupies substantially one-fourth of the periphery of said side wall, since this example has four inserts. The door 50 is normally held closed by means of a lock 11 and it can open by pivoting about a vertical hinge 51 connected to the remainder of the side wall 5.

In addition, the inserts 8 are now fixed relative to the ground, while the side wall 5 and the top 6 of the chest are mounted to rotate about a central vertical axis X embodied by a post 14: when the door 50 is open, it is thus possible to bring the opening left open by said door successively into register with each of the inserts 8 so as to enable the insert to be extracted from the chest 2 in order to be emptied.

As in the fourth embodiment of the invention, provision is also made for means that index the relative angular positions of the side wall 5 relative to the inserts 8 and for preventing any rotation of the side wall 5 when the door 50 is closed.

In the example shown in FIGS. 12 and 13, these means are constituted by a rim 52 which extends substantially radially inwards from the free vertical edge of the door 50 and which penetrates between two adjacent inserts 8 when the door 50 is closed.

In the example shown in FIGS. 12 and 13, as in the fourth embodiment of the invention, the bottoms 8*a* of the inserts 8 are advantageously situated beneath the level of the ground 4, and the door 50 is preferably secured to a portion of the top 6 of the chest that occupies an angular sector of substantially 90° so as to release the space situated above one of the inserts 8 when the door 50 is open.

Also, in order to further restrict the outside diameter of the superstructure of the chest 2 while nevertheless having inserts 8 of sufficient inside volume, the inserts 8 may advantageously be substantially boot-shaped, with the bottoms 8*a* of the inserts extending below the level of the ground 4 in the form of hollow projecting end portions 8*b* which project radially outwards. Each of said end portions 8*b* is engaged in a housing 3*b* which is preferably specific thereto, said housing being formed inside an enlarged base 3 situated beneath the level of the ground.

In order to enable an operator to extract the inserts 8 for the purpose of emptying them, the inserts are shaped to enable them to be tilted out from the chest 2 while they are being simultaneously raised, as shown by chain-dotted lines in FIG. 12: the projecting ends 8*b* of the inserts can thus pass into the empty space situated inside the relatively narrow diameter above ground portion of the base 3.

To this end, it is possible, for example, to provide for the radially inner portion of the bottom 8*a* of each insert to be rounded and for the radially outer portion of each insert situated above the projecting end 8*b* to have a local recess 8*c* level with the above-ground portion of the base 3.

It should be observed that it would be possible to use boot-shaped inserts 8 in the above-described second, third, and fourth embodiments.

Figure 14:
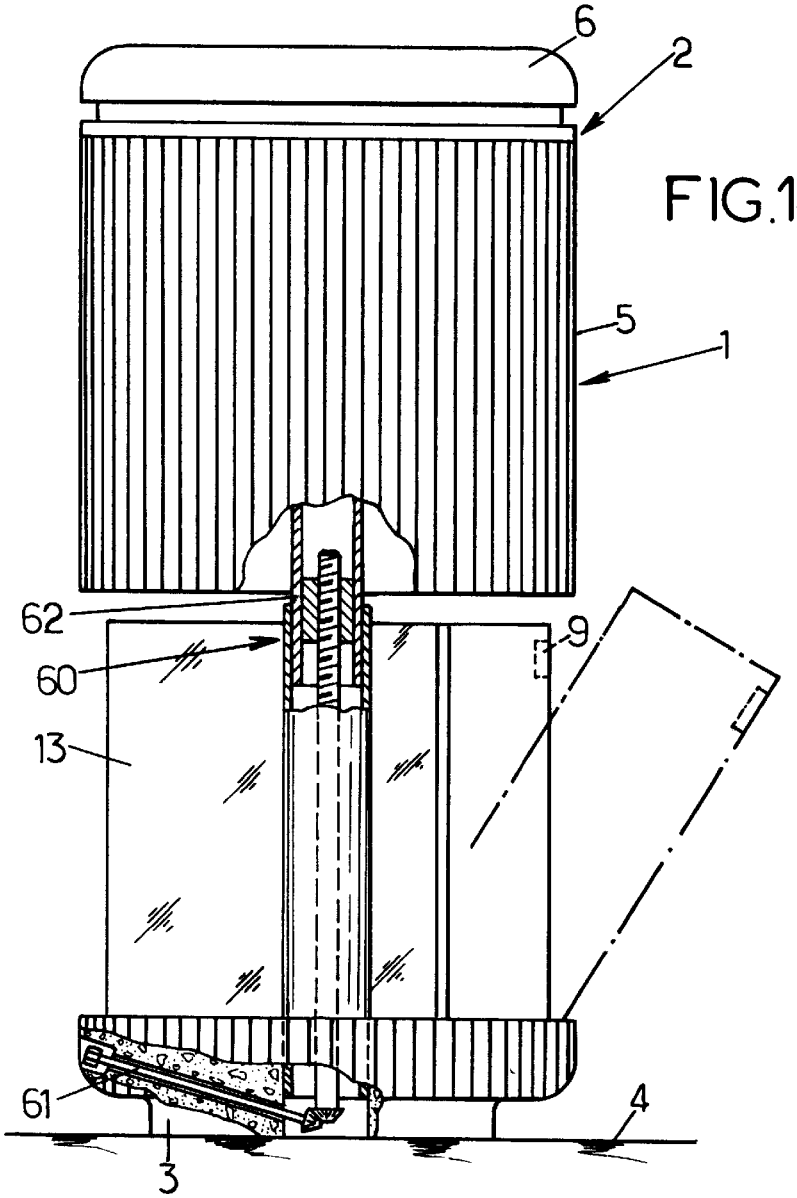
FIG. 14 is a partially cutaway view of a sixth embodiment of a litter bin of the invention in the open position.
Figure 15:
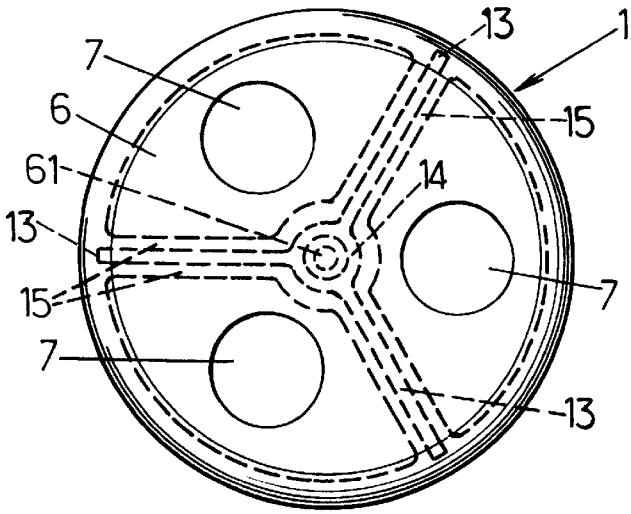
FIG. 15 is a plan view of the FIG. 14 litter bin.

Finally, in the sixth embodiment of the invention shown in FIGS. 14 and 15, the side wall 5 and the top 6 of the chest form a bell-shaped unit which can be displaced vertically by means of a screw jack 60 or by any other lifting means.

The screw jack is actuated from an inlet shaft 61 that is accessible from outside the chest 2, with actuation being provided, for example, by means of a crank handle (not shown) connected to the inlet shaft 61 by an operator when emptying the inserts 8.

In this embodiment, the inserts 8 are received in housings 15 e.g. defined between radial partitions 13 that are themselves secured to a central post 14 fixed to the base 3, the screw jack 60 being housed in said central post so as to raise or lower a tube 61 that slides vertically inside the post 14 and that is guided inside said post by a set of vertical ribs and grooves (not shown) or by other means, so that the waste-receiving openings 7 remain above the inserts 8.

When the side wall 5 and the top 6 are in a high position, as shown in FIG. 14, the inserts 8 are extracted by tilting said inserts out from the chest 2, as shown by chain-dotted lines in FIG. 14, or merely by causing the inserts to slide horizontally if they are merely placed on a smooth table.

Naturally, in this embodiment, the bottoms 8*a* of the inserts 8 could be situated beneath the level of the ground 4, and the bases of the inserts 8 could likewise have ends that project radially outwards, as in the above-described fifth embodiment.

We claim:

1. A litter bin comprising a hollow chest fixed to the ground and presenting a side wall and a top that is open in part for receiving waste, the chest containing waste-collection means and being capable of opening to enable waste to be removed, wherein the waste-collection means comprise a plurality of upwardly open inserts each having an inside volume lying in a range of 30 liters to 100 liters, the top of the chest having a plurality of waste-receiving openings disposed over respective ones of the inserts, the litter bin being shaped, when the chest is open, so as to enable all the inserts to be extracted manually in succession by a single operator for the purpose of emptying said inserts, each insert having a bottom which is situated beneath ground level, and the side wall of the chest having a moving panel which defines at least one lateral access opening disposed and shaped so as to allow at least one insert to pass therethrough, with said lateral access opening having a bottom edge which is situated at a height of less than 80 cm above the bottom of the insert.

2. A litter bin according to claim 1, in which the top of the chest has, for each moving panel of the side wall, a portion which is secured to said moving panel and which defines a top opening enabling at least one insert to be raised prior to being extracted laterally from the chest through the lateral access opening corresponding to said moving panel.

3. A litter bin according to claim 1, in which the inserts are partially contained inside a buried base which is liquid-proof and which has a peripheral top edge disposed at a height of more than 5 cm above the ground.

4. A litter bin according to claim 1, in which the inserts are boot-shaped, each having a base extended by a hollow end that projects horizontally outwards beneath the level of the ground, the chest having a buried base which itself includes, beneath the level of the ground an enlarged portion receiving said projecting ends, the chest and the inserts being shaped so as to allow the upper portions of the inserts to be tilted outwards from the chest through the lateral access openings, thereby disengaging the projecting ends at the bases of the inserts, after which said inserts can be raised and extracted from the chest via the lateral access openings.

5. A litter bin comprising a hollow chest fixed to the ground and presenting a side wall and a top that is open in part for receiving waste, the chest containing waste-collection means and being capable of opening to enable waste to be removed, wherein the waste-collection means comprise a plurality of upwardly open inserts each having a volume lying in a range of 30 liters to 100 liters, the top of the chest having a plurality of waste-receiving openings disposed over respective ones of the inserts, the litter bin being shaped, when the chest is open, so as to enable all the inserts to be extracted manually in succession by a single operator for the purpose of emptying said inserts, each insert having a bottom which is situated beneath ground level, the side wall of the chest having a moving panel which defines at least one lateral access opening disposed and shaped so as to allow at least one insert to pass therethrough, with said lateral access opening having a bottom edge which is situated at a height of less than 80 cm above the bottom of the insert, the chest being substantially circularly cylindrical in shape about a vertical axis of symmetry, each of the inserts having a horizontal section that is substantially in the form of an angular sector, and the chest further including positioning means for placing each insert beneath a waste-receiving opening.

6. A litter bin according to claim 1, in which the positioning means include housings situated inside the chest and secured to said chest so that each of them can receive a respective insert.

7. A litter bin comprising a hollow chest fixed to the ground and presenting a side wall and a top that is open in part for receiving waste, the chest containing waste-collection means and being capable of opening to enable waste to be removed, wherein the waste-collection means comprise a plurality of upwardly open inserts each having a volume lying in a range of 30 liters to 100 liters, the top of the chest having a plurality of waste-receiving openings disposed over respective ones of the inserts, the litter bin being shaped, when the chest is open, so as to enable all of the inserts to be extracted manually in succession by a single operator for the purpose of emptying said inserts, the chest being substantially circularly cylindrical in shape about a vertical axis of symmetry, each of the inserts having a horizontal section that is substantially in the form of an angular sector, the chest further including positioning means for placing each insert beneath a waste-receiving opening, the side wall of the chest including a moving panel which defines a single lateral access opening, means being provided to enable relative rotation between the side wall of the chest and the inserts about the vertical axis of symmetry to bring each of the inserts successively into coincidence with the lateral access opening so as to enable said inserts to be extracted and emptied.

8. A litter bin according to claim 7, which the inserts are carried by a support which is mounted to rotate about the vertical axis of symmetry, while the side wall of the chest is fixed relative to the ground.

9. A litter bin according to claim 7, in which at least the side wall of the chest is mounted to rotate about the vertical axis of symmetry, while the inserts are positioned by a support which is fixed relative to the ground.

10. A litter bin according to claim 7, in which the side wall is secured to the top of the chest and the positioning means comprise indexing means for defining a plurality of relative angular positions between the inserts and the side wall of the chest, each waste-receiving opening coinciding with one of the inserts in each of said angular positions.

11. A litter bin according to claim 7, in which the side wall is secured to the top of the chest and the positioning means comprise locking means for preventing any relative rotation between the inserts and the side wall of the chest when the lateral access opening of the chest is closed.

12. A litter bin comprising a hollow chest presenting a side wall and a top that is open in part for receiving waste, the chest containing waste-collection inserts, the waste-collection inserts being upwardly open, the top of the chest having a plurality of waste-receiving openings disposed over respective ones of the inserts, each insert having a bottom which is situated beneath ground level, and at least one of the top and a portion of the side wall being openable to allow removal of the inserts.

13. A litter bin according to claim 1, in which the side wall of the chest has a plurality of panels each extending between a bottom end and a top end, each insert being fastened to one of said panels and each panel being mounted to pivot through an angle of less than 45° about a horizontal axis in the vicinity of its bottom end, between a vertical position and a tilted position inclined towards the outside of the litter bin, thereby enabling the insert secured to said panel to be extracted.

14. A litter bin according to claim 1, in which at least the side wall assembly of the chest is displaceable vertically under drive from control means between an in-use position where said side wall surrounds the inserts and an emptying position where said side wall is situated above said inserts, enabling the inserts to be extracted laterally.

15. A litter bin according to claim 1, in which the top of the chest forms a cover which is pivotally mounted about a horizontal axis between a closed position and an open position enabling the inserts to be extracted upwards, the cover being urged towards its open position vertical plane lying between two inserts.

16. A litter bin comprising a hollow chest fixed to the ground and presenting a side wall and a top that is open in part for receiving waste, the chest containing waste-collection means and being capable of opening to enable waste to be removed, wherein the waste-collection means comprise a plurality of upwardly open inserts each having an inside volume lying in a range of 30 liters to 100 liters, the top of the chest having a plurality of waste-receiving openings disposed over respective ones of the inserts, the litter bin being shaped, when the chest is open, so as to enable all the inserts to be extracted manually in succession by a single operator for the purpose of emptying said inserts, the chest having a vertical axis of symmetry, the side wall of the chest including a moving panel which defines a single lateral access opening, means being provided to enable relative rotation between the side wall of the chest and the inserts about the vertical axis of symmetry to bring each of the inserts successively into coincidence with the lateral access opening so as to enable said inserts to be extracted and emptied.

17. A litter bin comprising a hollow chest presenting a side wall and a top that is open in part for receiving waste, the chest containing waste-collection means and being capable of opening to enable waste to be removed, wherein the waste-collection means comprise a plurality of upwardly open inserts, the top of the chest having a plurality of waste-receiving openings disposed over respective ones of the inserts, and the litter bin being shaped, when the chest is open, so as to enable all the inserts to be extracted manually in succession by a single operator for the purpose of emptying said inserts, each insert having a bottom which is situated beneath ground level, the side wall of the chest having a moving panel which defines at least one lateral access opening disposed and shaped so as to allow at least one insert to pass therethrough, with said lateral access opening having a bottom edge which is situated at a height of less than 80 cm above the bottom of the insert.

18. A litter bin comprising a hollow chest presenting a side wall and a top that is open in part for receiving waste, the chest containing waste-collection means and being capable of opening to enable waste to be removed, wherein the waste-collection means comprise a plurality of upwardly open inserts, the top of the chest having a plurality of waste-receiving openings disposed over respective ones of the inserts, and the litter bin being shaped, when the chest is open, so as to enable all of the inserts to be extracted manually in succession by a single operator for the purpose of emptying said inserts, the chest being substantially circularly cylindrical in shape about a vertical axis of symmetry, each of the inserts having a horizontal section that is substantially in the form of an angular sector, the chest further including positioning means for placing each insert beneath a waste-receiving opening, the side wall of the chest including a moving panel which defines a single lateral access opening, means being provided to enable relative rotation between the side wall of the chest and the inserts about the vertical axis of symmetry to bring each of the inserts successively into coincidence with the lateral access opening so as to enable said insert to be extracted and emptied.

19. A litter bin comprising a hollow chest presenting a side wall and a top that is open in part for receiving waste, the chest containing waste-collection means and being capable of opening to enable waste to be removed, wherein the waste-collection means comprise a plurality of upwardly open inserts, the top of the chest having a plurality of waste-receiving openings disposed over respective ones of the inserts, and the litter bin being shaped, when the chest is open, so as to enable all the inserts to be extracted manually in succession by a single operator for the purpose of emptying said inserts, the chest having a vertical axis of symmetry, the side wall of the chest including a moving panel which defines a single lateral access opening, means being provided to enable relative rotation between the side wall of the chest and the inserts about the vertical axis of symmetry to bring each of the inserts successively into coincidence with the lateral access opening so as to enable said inserts to be extracted and emptied.

* * * * *